US011096483B2

(12) United States Patent
Rehage et al.

(10) Patent No.: US 11,096,483 B2
(45) **Date of Patent: *Aug. 24, 2021**

(54) HOUSEHOLD APPLIANCE, IN PARTICULAR A REFRIGERATOR OR A FREEZER OR A FURNITURE ITEM COMPRISING AT LEAST ONE SHELF

(71) Applicant: PAUL HETTICH GMBH & CO. KG, Kirchlengern (DE)

(72) Inventors: Daniel Rehage, Chemnitz (DE); Andreas Matthes, Chemnitz (DE); Ulrich Siegert, Limbach-Oberfrohna (DE); Bernd Lehmann, Chemnitz (DE); Mathias Winkler, Chemnitz (DE); Gottfried Fiedler, Hohenstein-Ernstthal (DE); Hartmut Enderlein, Chemnitz (DE)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/495,491

(22) PCT Filed: Mar. 16, 2018

(86) PCT No.: PCT/EP2018/056696
§ 371 (c)(1),
(2) Date: Sep. 19, 2019

(87) PCT Pub. No.: WO2018/172215
PCT Pub. Date: Sep. 27, 2018

(65) Prior Publication Data

US 2020/0170408 A1 Jun. 4, 2020

(30) Foreign Application Priority Data

Mar. 22, 2017 (DE) ..... 102017106171.1

(51) Int. Cl.
*A47B 49/00* (2006.01)
*A47B 77/10* (2006.01)
(Continued)

(52) U.S. Cl.
CPC ..... *A47B 49/004* (2013.01); *A47B 77/10* (2013.01); *A47B 96/025* (2013.01); *F25D 25/024* (2013.01); *F25D 25/027* (2013.01)

(58) Field of Classification Search
CPC ..... A47B 49/004; A47B 77/10; A47B 96/025; A47B 81/002; A47B 96/04; A47B 37/00;
(Continued)

(56) References Cited

U.S. PATENT DOCUMENTS 535,886 A * 3/1895 Brand ..... F04D 25/08 5/173
2,316,408 A * 4/1943 Dawson ..... F16H 25/14 74/55
(Continued)

FOREIGN PATENT DOCUMENTS

DE 1198026 8/1965
DE 9300364 5/1993
(Continued)

OTHER PUBLICATIONS

Search Report issued in German Appl. No. 102017106171.1 (dated 2018).
(Continued)

*Primary Examiner* — Hanh V Tran
(74) *Attorney, Agent, or Firm* — Barnes & Thornburg LLP

(57) ABSTRACT

A household appliance, in particular a refrigerator or a freezer or a furniture item comprising at least one storage space, in which a support plate is positioned comprising a
(Continued)

storage area and a shelf which can be rotationally and translationally moved on the storage area of the support plate, wherein: the shelf comprises a flat storage area which is oriented plane-parallel to the storage area of the support element; the shelf can be rotated relative to the support plate in a first rotational direction and can be displaced in a predefined direction; mutually facing bearing surfaces of the storage areas each have closed peripheral raceway grooves in which rolling elements are guided; the raceway grooves are formed such that, when a force is applied to the shelf in a direction defined in the plane of the storage area, the shelf can be moved, in a movement which is at least partially forcibly guided and which is simultaneously rotational and translational, from a base position into an intermediary position, the shelf being rotated relative to the support plate in one of two possible opposing rotational directions and being displaced in a predefined direction; and the shelf, after being moved into the intermediary position, can be further rotated relative to the support plate in the one of two possible opposing rotational directions and can be displaced counter to the predefined direction and, when rotated by 180°, resumes the base position.

16 Claims, 7 Drawing Sheets

(51) Int. Cl.
*A47B 96/02* (2006.01)
*F25D 25/02* (2006.01)

(58) Field of Classification Search
CPC ..... A47B 96/027; A47B 83/045; A47B 2037/005; F25D 25/024; F25D 25/027
See application file for complete search history.

(56) References Cited

U.S. PATENT DOCUMENTS 2,540,125 A * 2/1951 Kolks ..... F16H 25/14 74/55
2,647,812 A * 8/1953 Saunders ..... F25D 25/027 312/294
2,840,438 A * 6/1958 Sharpe ..... F25D 25/027 312/322
2,936,205 A * 5/1960 Clark ..... F25D 25/027 312/302
3,107,959 A * 10/1963 Maxwell, Jr. ..... F25D 25/02 312/322
4,124,262 A * 11/1978 Schill ..... A47B 49/004 16/378
4,392,628 A * 7/1983 Hadfield ..... A47B 49/004 211/144
4,582,372 A * 4/1986 Cooper ..... A47B 46/00 108/140
6,322,679 B1 * 11/2001 De Bosscher ..... H01J 37/3408 204/192.12
6,585,119 B2 * 7/2003 Palder ..... A47F 5/02 211/163
7,147,445 B2 * 12/2006 Krayer ..... F16N 13/20 418/150
9,022,495 B1 * 5/2015 Conner, Sr. ..... F25D 25/027 312/408
9,052,134 B1 * 6/2015 Batchler ..... F25D 25/02
9,528,753 B1 * 12/2016 Conner, Sr. ..... A47F 3/08
2002/0117943 A1 * 8/2002 Gerkey ..... A47B 49/006 312/238
2005/0196310 A1 * 9/2005 Krayer ..... A47B 81/002 418/61.3
2009/0079305 A1 * 3/2009 Hirayoshi ..... A47B 46/00 312/209
2010/0176074 A1 * 7/2010 Andersen ..... A47F 5/0087 211/59.2
2017/0184335 A1 * 6/2017 Jeon ..... F25D 23/04
2020/0170408 A1 * 6/2020 Rehage ..... A47B 96/025
2020/0187641 A1 * 6/2020 Rehage ..... A47B 49/004
2020/0191471 A1 * 6/2020 Rehage ..... A47B 49/004

FOREIGN PATENT DOCUMENTS

JP 2011122737 6/2011
JP 2011247445 12/2011
KR 100188345 6/1999

OTHER PUBLICATIONS

Search Report issued in Int'l Appl. No. PCT/EP2018/056696 (dated 2018).

* cited by examiner

HOUSEHOLD APPLIANCE, IN PARTICULAR A REFRIGERATOR OR A FREEZER OR A FURNITURE ITEM COMPRISING AT LEAST ONE SHELF

CROSS-REFERENCE TO RELATED APPLICATIONS

This application is a U.S. nationalization under 35 U.S.C. § 371 of International Application No. PCT/EP2018/056696, filed Mar. 16, 2018, which claims priority to German Patent Application No. 102017106171.1, filed Mar. 22, 2017. The disclosures set forth in the referenced applications are incorporated herein by reference in their entireties.

BACKGROUND AND SUMMARY OF THE DISCLOSURE

The present is directed to a household appliance, in particular a refrigerator or freezer, or a furniture item having at least one storage space or a storage surface, in which or on which at least one carrier plate having a bearing region and a shelf rotationally and translationally movable on the bearing region of the carrier plate is arranged.

In household appliances, for example, refrigerators or freezers and/or in cupboards, areas which are difficult to reach are often present in a storage space or on a storage surface. The ability to reach in particular objects deposited in the rear region of a storage space or a storage surface is often only possible to a very restricted extent. Storage spaces arranged in a particularly user-unfriendly manner, for example, above the head height of a person or below the knee height, can only be reached with difficulty.

Turning out or pivoting out a turntable which is installed in this storage space or on the storage surface appears reasonable to remedy these above-mentioned disadvantages.

In the household appliances or furniture items known from the prior art, predominantly sequentially rotational and translational movements are combined with one another, wherein these two types of movements generally run separately from one another and/or in succession. Such solutions are very technically complex. The rotational movement is frequently only possible to a restricted extent in this case, in particular only by 90°, which further obstructs the accessibility of the elements deposited in such storage spaces or on such storage surfaces. In addition, numerous solutions have weak points in the absorption of support forces and stability, and also have large structural heights.

The present disclosure is directed to an improved household appliance, in particular a refrigerator or freezer, or a furniture item having at least one storage space or at least one storage surface, in which or on which at least one carrier plate having a bearing region and a shelf rotationally and translationally movable on the bearing region of the carrier plate is arranged, using which the above-mentioned disadvantages are remedied.

A household appliance according to the present disclosure, having at least one storage space, in which at least one carrier plate having a bearing region and a shelf rotationally and translationally movable on the bearing region of the carrier plate is arranged, wherein the shelf has a planar bearing region, which is aligned plane-parallel to the bearing region of the carrier element, wherein the shelf is rotatable in a first rotational direction and displaceable in a predetermined direction in relation to the carrier plate, is distinguished in that bearing surfaces of the bearing regions facing toward one another each have closed, peripheral running grooves, in which roller bodies are guided.

The running grooves are shaped in such a manner that if a force acts on the shelf in a direction defined in the plane of the bearing region, the shelf is movable in a positively-guided, simultaneously rotational and translational movement from a base position via an intermediate position, during which the shelf is rotated in relation to the carrier plate in one of two possible opposing rotational directions and is displaced in a predetermined direction, wherein the object is pivotable in relation to the carrier plate after the movement into the intermediate position further in the one of two possible opposing rotational directions and is displaceable opposite to the predetermined direction and occupies the base position again upon a pivot by 180°. One intermediate position is located approximately at 90°. The object is rotatable by arbitrary angles in relation to the carrier plate.

The positively-guided, simultaneously rotational and translational movement between shelf and carrier plate may exist in a range between base position and shortly before reaching the intermediate position, which may be at 90°, in each of the two possible opposing rotational directions. There can also be only one rotational movement in the range of the 90° position of the shelf in relation to the carrier plate.

Due to the bearing surfaces of the bearing regions equipped with the peripheral running grooves, which enable an at least partially simultaneous rotational and translational movement, the shelf is movable in a simple manner on the carrier plate.

The simple construction of this arrangement by the introduction of the closed peripheral running grooves into the lower side of the shelf and into the upper side of the carrier plate may reduce production costs, enhance the robustness of the device, and provide for user-friendly operation. The ability to reach elements arranged in the rear region of the storage space or the storage surface is thus improved.

According to an embodiment, two closed, peripheral running grooves are introduced into one of the bearing regions and precisely one closed, peripheral running groove is introduced into the other of the bearing regions.

In this case, each of the three running grooves particularly preferably has the same profile contour, wherein one of the two running grooves is formed mirrored in relation to the running groove and the other of the two running grooves is formed rotated by 180° and displaced by a predetermined amount in relation to the one of the two running grooves.

Using such a running groove contour, a simultaneously rotational and translational movement of the shelf in relation to the carrier plate which is simple to operate is enabled.

The roller bodies are formed as balls according to one embodiment, which enables a low-friction relative movement of the shelf in relation to the carrier plate.

To enable the support load on the individual roller bodies while maintaining a simple running groove design, four such roller bodies are preferably guided in the running grooves.

According to a further embodiment, the roller bodies are held, preferably captively, in a roller body cage. The positive guiding of the roller bodies during the movement in the running grooves is thus improved once again.

The bearing regions of the shelf or the carrier plate are formed in one piece with the carrier plate or the shelf, respectively, according to an embodiment.

In an alternative embodiment, at least one of the bearing regions is formed as a separate element, which is insertable into a correspondingly shaped receptacle in the carrier plate or the shelf, or which is attachable to the carrier plate or the shelf, respectively by connecting means.

According to a further embodiment, a guide, for example, a slot extending in the translational movement direction, is arranged on or in the one of the bearing regions and a guiding or holding element is arranged on or in the other bearing region. For example, a borehole is introduced into the one bearing region, in which a guiding and holding pin or bolt is accommodated. This also contributes to further improving the positive guiding. Moreover, the shelf and the carrier plate can thus be held on one another axially in a simple manner.

The closed peripheral running grooves are, according to a further embodiment, each introduced around the center point of the bearing region of the shelf and the bearing region of the carrier plate up to a front edge of the carrier plate in the direction of the translational movement of the shelf.

This enables a large contact surface. Furthermore, a particularly favorable load absorption results in this manner, which also enhances the stability of the entire device.

For improved positioning of the shelf in the base position, the closed peripheral running grooves may have multiple catch points for the roller bodies in the base position, which are reached after each rotation of the shelf by 180°.

According to a further embodiment, the shelf is rotatable in relation to the carrier plate in a first rotational direction and in an opposing second rotational direction, which further simplifies the operability of the device.

A further simplification of the operability of the device is achieved in that the shelf is rotatable in relation to the carrier plate in a first rotational direction and in an opposing second rotational direction by arbitrary angles.

The carrier plate is installed recumbent in the storage space according to one embodiment. However, it is also conceivable to install the carrier plate hanging or standing vertically.

In the following description of the figures, terms such as upper, lower, left, right, front, rear, etc. refer exclusively to the illustration and position selected by way of example in the respective figures of the carrier plate, the shelf, the bearing region, the roller bodies, the running groove, and the like. These terms are not to be understood as restrictive, i.e., these references can change due to different operating positions or mirror-symmetric design or the like.

Figure 7:
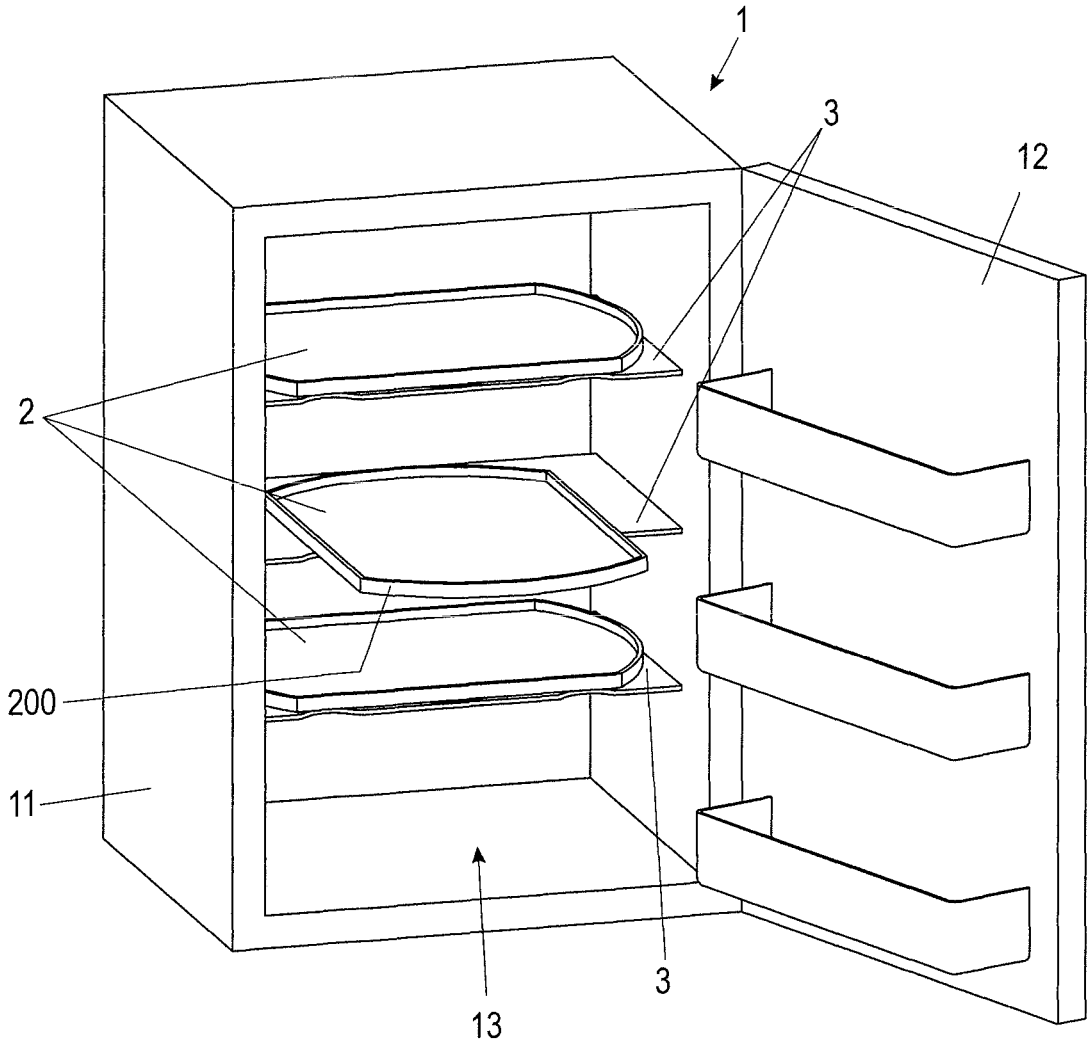
FIG. 7 shows a perspective illustration of a refrigerator or freezer having multiple objects formed as shelves.

In the exemplary embodiment shown in FIG. 7, a conventional glass bottom panel in a storage space 13 of a refrigerator 1 is replaced by a carrier plate 3 having a bearing region 5 and an object, in the form of a shelf 2 having a bearing region 4, rotationally and translationally movable on the bearing region 5 of the carrier plate 3. The refrigerator 1 consists of a body 11, on which a door 12 is linked so it is pivotable and which closes the storage space 13.

Figure 8:
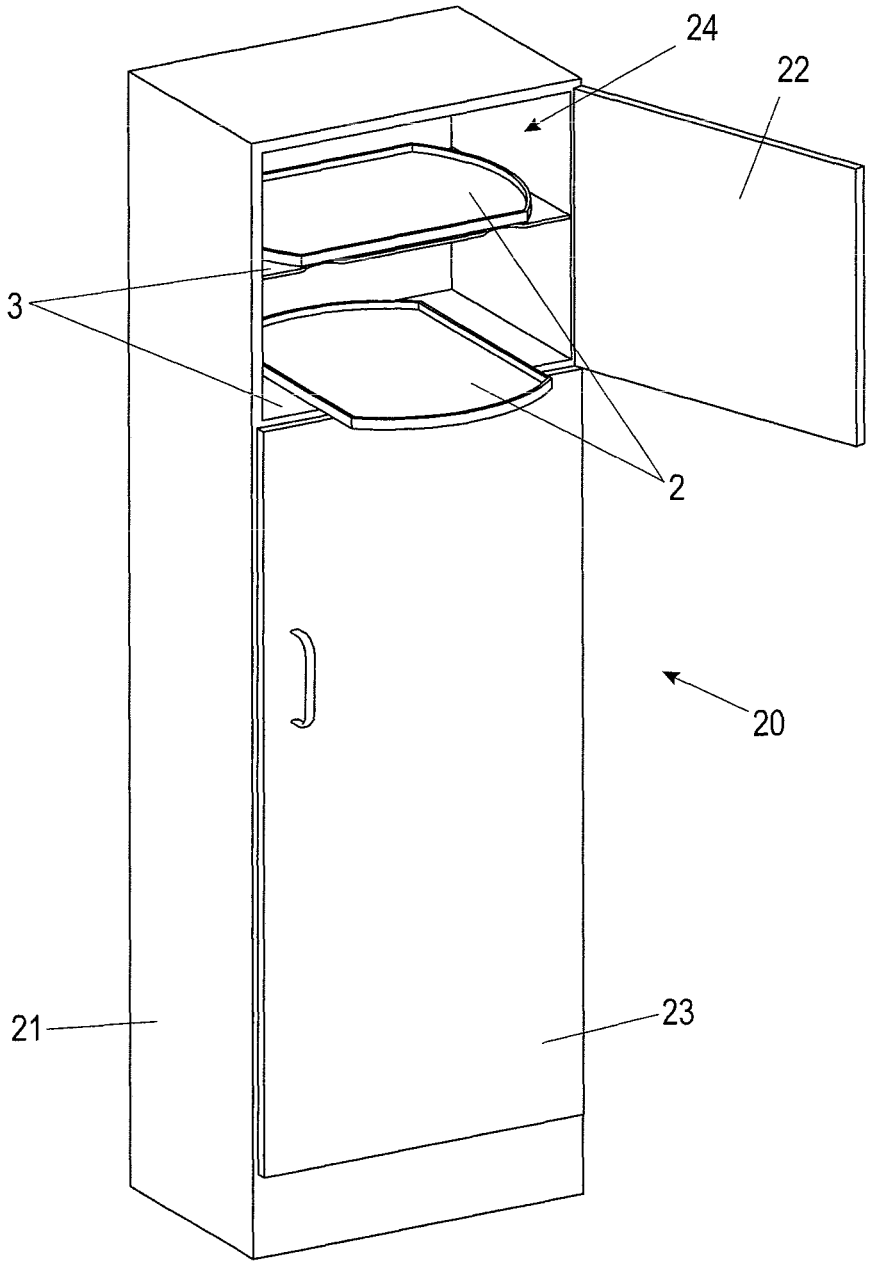
FIG. 8 shows a perspective illustration of a cupboard having multiple objects formed as shelves.

Accordingly, in the exemplary embodiment shown in FIG. 8, a conventional shelf bottom panel in a storage space 24 of a cupboard 20 is replaced by a carrier plate 3 having a bearing region 5 and an object, in the form of a shelf 2 having a bearing region 4, rotationally and translationally movable on the bearing region 5 of the carrier plate 3. The cupboard 20 consists of a body 21, on which two doors 22, 23 are linked so they are pivotable and which close the storage space 14.

The rotationally and translationally mounted shelf 2, embodied here as a plate-shaped shelf having a planar bearing region, is available as a storage surface for the refrigerated material to be stored in the case of use in a refrigerator 1 and has the shape of a circle, in which two opposing circular segments of equal size are removed. An optimum storage surface for the refrigerated material thus results. Furthermore, a handle and holding element 200 for the operation of the shelf 2 and for securing the stored refrigerated material is located on the shelf 2.

The bearing surfaces of these bearing regions 4, 5 facing toward one another each have closed, peripheral running grooves 41, 51, in which roller bodies 6 are guided. The roller bodies 6 are preferably formed as balls in this case.

The running grooves 41, 51 are shaped so that if a force acts on the shelf 2 in a direction A defined in the plane of the bearing region, the shelf 2 is movable in a positively-guided, simultaneously rotational and translational movement from a base position via an intermediate position, in which the shelf 2 is rotated in relation to the carrier plate 3 in a first rotational direction $R_1$ and is displaced in a predetermined direction A.

In one preferred intermediate position, the shelf 2 is pivoted by approximately 90° in relation to the base position, wherein the displacement reaches its maximum in the predetermined direction.

The shelf 2 can be moved back into the base position by it being rotated further in the rotational direction $R_1$, for this purpose the shelf 2 is pivoted in relation to the carrier plate 3 by a total of 180° and displaced opposite to the predetermined direction A back into the base position.

Alternatively, the shelf 2 can be moved back into the base position by being rotated back opposite to the rotational direction $R_1$ in the rotational direction $R_2$. The direction A denotes the direction out of the storage space 13, 24 of the refrigerator 1 or the cupboard 20, respectively, here.

Figure 1:
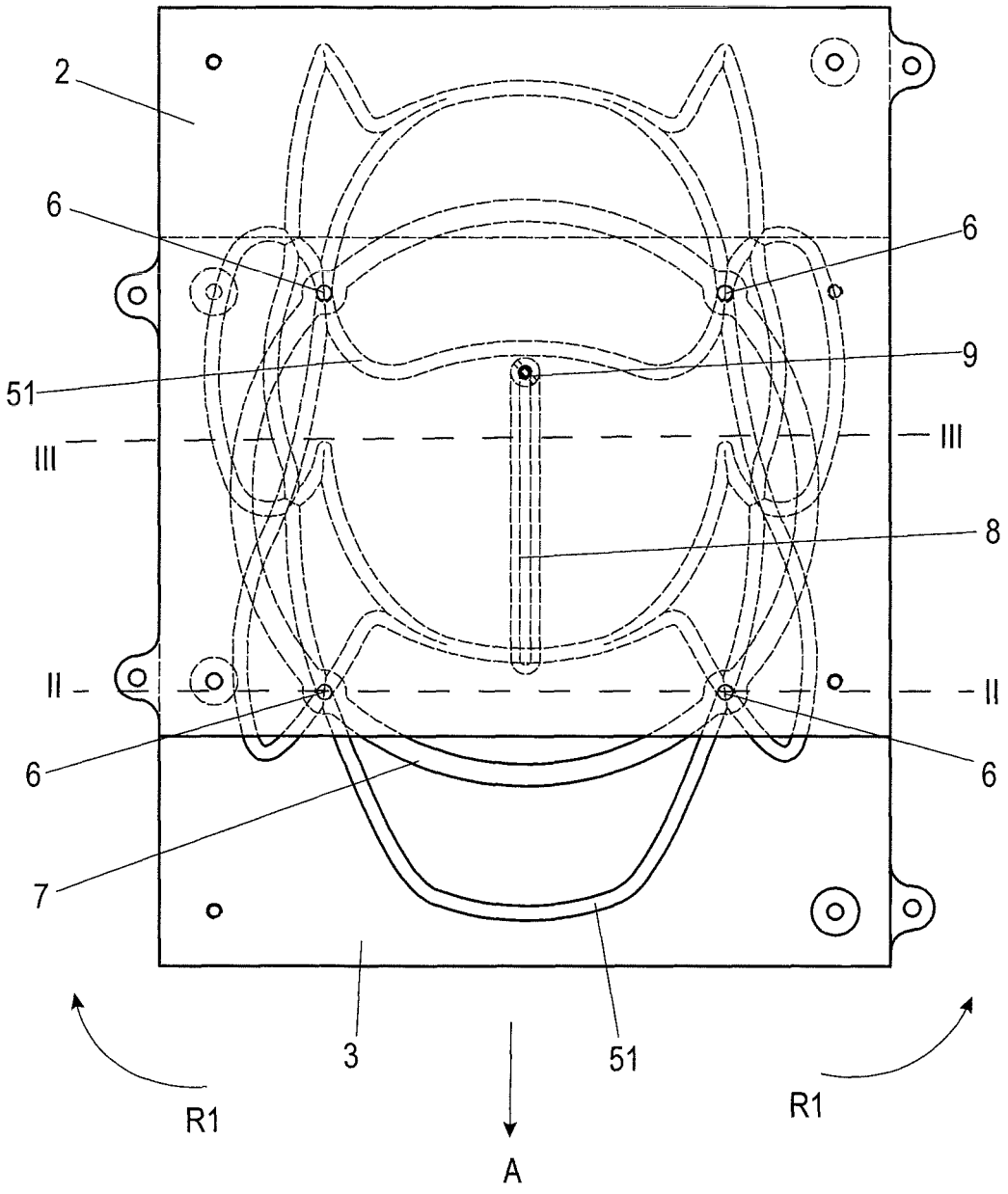
FIG. 1 shows a top view of an embodiment variant of a device according to thepresent disclosure.
Figure 2:
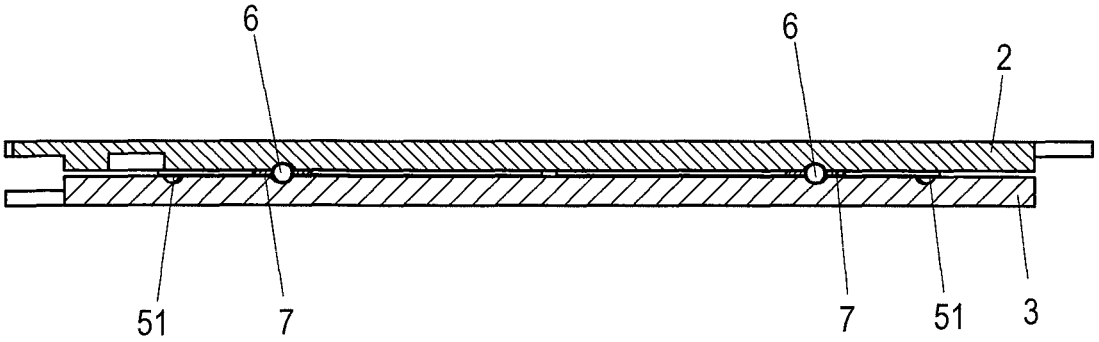
FIG. 2 shows a sectional view through a plane of section identified with II in FIG. 1.
Figure 3:
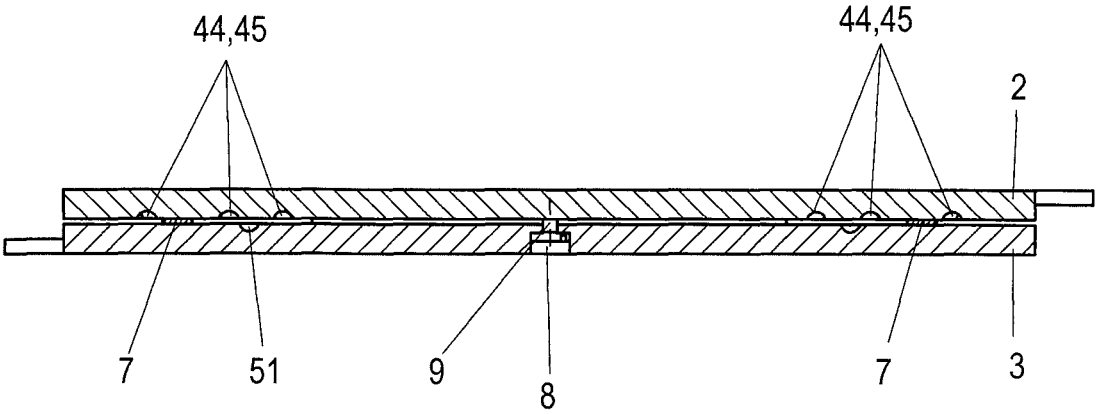
FIG. 3 shows a sectional view through a plane of section identified with III in FIG. 1.
Figure 4:
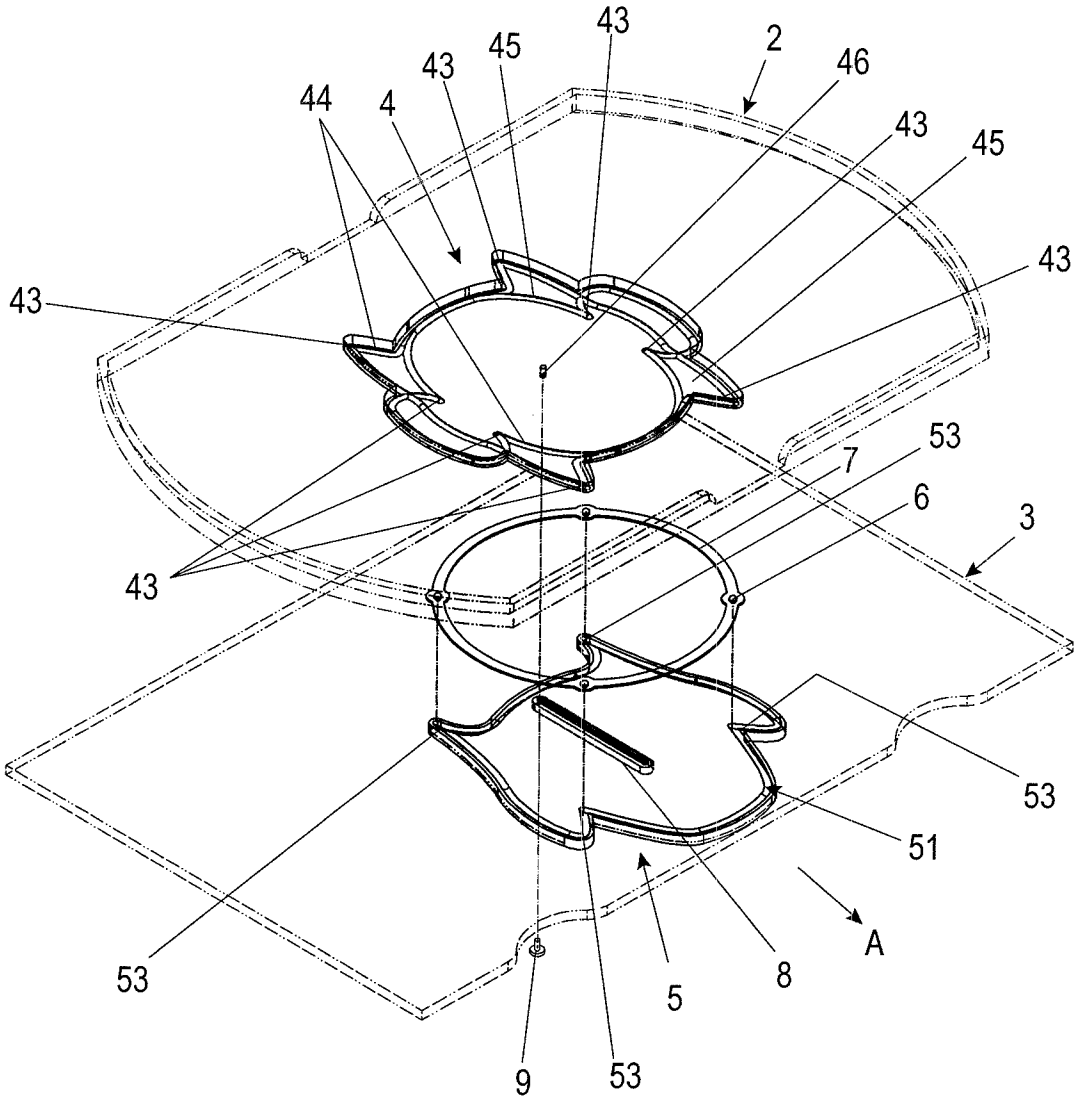
FIG. 4 shows a perspective exploded illustration of the device shown in FIG. 1.
Figure 5:
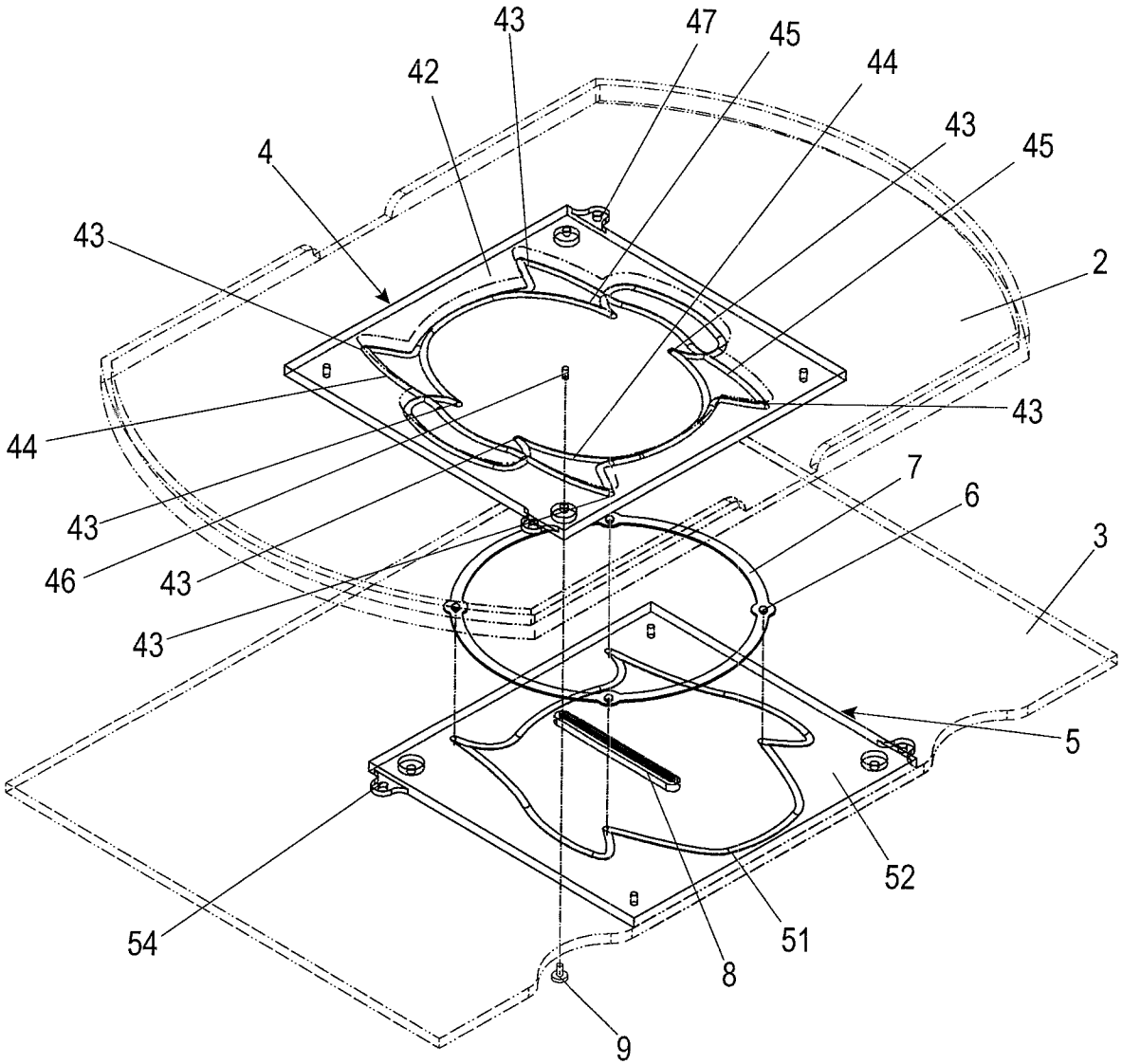
FIG. 5 shows a perspective exploded illustration of an alternative embodiment, in which the bearing regions are formed as separate elements.
Figure 6:
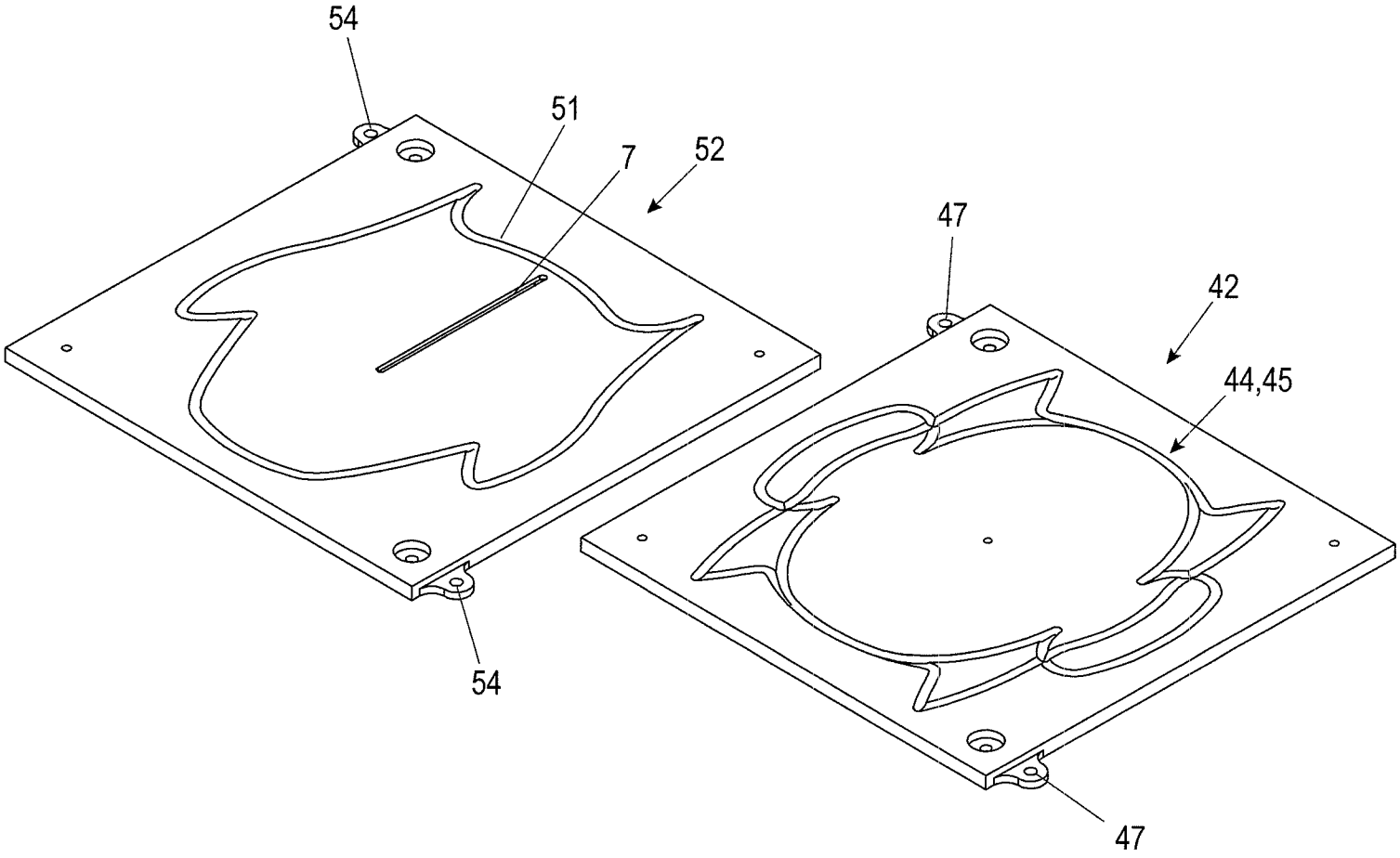
FIG. 6 shows a perspective illustration of the bearing regions formed as separate elements.

As shown in FIGS. 4 to 6, two closed, peripheral running grooves 44, 45 are introduced into the bearing region 4 of the shelf 2. Precisely one closed, peripheral running groove 51 is introduced into the bearing region 5 of the carrier plate 3.

The reverse arrangement is also conceivable, in which two running grooves are introduced into the bearing region 5 of the carrier plate 3 and one running groove is introduced into the bearing region 4 of the shelf 2.

The three running grooves 44, 45, 51 are preferably of identical formation. In this case, as can be seen well in FIGS. 4 and 5, one of the two running grooves 44 of the bearing region 4 of the shelf is mirrored in relation to the running groove 51. The other of the two running grooves 45 is formed rotated by 180° in relation to the running groove 44 and displaced by the amount of the translational movement.

The closed peripheral running grooves 44, 45, 51 in the shelf 2 and the fixed carrier plate 3 effectuate the positive guiding of the roller bodies 3 during the actuation of the shelf 2, a simultaneous rotation and pulling out of the shelf 2.

As is furthermore shown in FIGS. 2, 3, 4, and 5, the roller bodies 6, which are formed as balls here, are held in a roller body cage 7. The roller bodies 6 are preferably held captively in the roller body cage 7 in this case. It is also conceivable to solely guide the roller bodies in openings of the roller body cage 7 provided for this purpose.

For the axial fixing of the carrier plate 3 with the shelf 2, a guide 8 in the form of a slot extending in the translational movement direction A is introduced into the bearing region 5 of the carrier plate 3. A borehole 46 is introduced centrally into the bearing region 4 of the shelf 2 so that the shelf 2 is coaxially fixed concentrically. A guiding and holding element in the form of a pin 9 passes through the slot 8 and the borehole 46 in this case and thus ensures axial fixing of the shelf 2 on the carrier plate 3. If the carrier plate 3 and the shelf 2 resting thereon is installed horizontally, the axial safeguard can also be omitted. More than one axial safeguard or a differently embodied axial safeguard can also be provided.

While in the embodiment shown in FIG. 4, the bearing regions 4, 5 are formed in one piece with the shelf 2 or the carrier plate 3, respectively, in which the running grooves 44, 45, 51 are introduced directly into the lower side of the shelf 2 or the upper side of the carrier plate 3, respectively, in the embodiment shown in FIG. 5, the bearing regions 4, 5 are formed as separate elements in the form of bearing plates 42, 52, which are fastenable on the lower side of the shelf 2 or on the upper side of the carrier plate 3, respectively.

For this purpose, respective fastening receptacles 54, 47 are formed on lateral edges of the bearing plate 42, 52, into which screws are insertable, using which the bearing plates 42, 52 are fixable on the shelf 2 or on the carrier plate 3, respectively.

To keep the load on the roller bodies 6 as low as possible and simultaneously enable a simply constructed running groove, in the embodiment variant shown here, four such roller bodies 6 formed as balls are guided in the running grooves 44, 45, 51. Alternatively, two or eight roller bodies can also be provided.

As shown in FIGS. 4, 5, and 6, the closed peripheral running grooves 44, 45, 51 are introduced via the center point of the bearing region 4 of the shelf and the bearing region 5 of the carrier plate 3 up into a front edge of the carrier plate 3 in the direction A of the translational movement of the shelf 2.

To be able to latch the shelf 2 easily in the base position, in which the shelf 2 does not protrude over the front lateral edge of the carrier plate 3, the closed peripheral running grooves 44, 45, 51 comprise multiple catch points 43, 53 for the roller bodies 6 in the base position. This base position is reached after each rotation of the shelf 2 by 180°.

In a further embodiment, selected intermediate positions can also have catch points, for example, upon a pivot of the shelf 2 in relation to the carrier plate 3 by 90°.

The catch points 43, 53 are distinguished in that a somewhat elevated application of force is required for the movement out of these positions. This elevated application of force can be achieved, for example, by a corresponding formation of the running grooves 44, 45, 51 having depressions or elevated nubs or the like. Other elements for influencing the force, for example, magnets, are also conceivable. In the formation of the running grooves 44, 45, 51 shown here, the shelf 2 is enabled to be rotatable in relation to the carrier plate 3 in a rotational direction $R_1$ and also in an opposing rotational direction $R_2$.

In addition, the shelf 2 can be rotated by arbitrary angles with this formation of the running grooves 44, 45, 51. It is thus possible to rotate the shelf 2 during a first rotational movement by 180° in relation to the carrier plate 3 in the rotational direction $R_1$ and during a subsequent actuation to rotate the shelf 2 once again in the same rotational direction $R_1$ or alternatively to rotate it in the opposing rotational direction $R_2$.

During the usage, by pulling on the handle and holding element 200, which effectuates the introduction of a lateral force, the shelf 2 is set into motion rotating to the right or left by moving the roller bodies 6 out of the catch points 43, 53. At the same time, in addition to the rotational movement of the shelf 2, the translational movement to the front is executed up to its end point in a positively-guided manner simultaneously. During further rotation, the translation back to the rear is resumed again between the 90° position and 180° position and a base position in the catch points 43, 53 is reached after a 180° rotation. After a further 180° rotation, the base position is reached. In the entire cycle of the rotational and translational movement of the shelf 2 by 360°, equipping with refrigerated material and access to the refrigerated material are possible.

Due to the geometric formation of the closed running grooves in the lower side of the shelf 2 and in the upper side of the carrier plate 3 around the respective center point of the shelf 2 and the carrier plate 3 having the greatest possible spacing from the respective center point, as much as possible up to the front edge of the shelf 2 and the carrier plate 3, a large contact surface is achieved, which absorbs support forces well and enhances the stability of the entire device.

The usage capability is enhanced by the positive guiding, the structural height is reduced due to the compact construction, and incorrect operations are prevented. The unlimited movement angle—rotating to the right and left—enables an arbitrary sequence without a preferential direction by 360°. The simple construction reduces the production costs and enhances the robustness of the guide device.

It is apparent in FIG. 7 and FIG. 8 that the shelf 2 does not protrude beyond the rear edge of the carrier plate 3 in the direction A in the intermediate position of approximately 90°.

In addition to the exemplary embodiment of the cupboard 20 shown in FIG. 8, it is also conceivable to install such a rotationally and translationally movable shelf 2 in a dresser or lowboard.

It is also conceivable that in a furniture item designed as a closet or wardrobe, the hanging textiles are hung parallel to the front. The device then enables simple access to those hanging at the rear.

A usage in the medical field or in the sales field (refrigerating and freezing devices) in shopping malls is also conceivable. Many small packaging units have to be organized therein. Due to the access option to a front and a rear region of the rotationally and translationally movable shelf 2, the comprehensibility is enhanced. In addition, it facilitates the access if an access is possible from the front and from the rear.

The use of a rotationally and translationally movable shelf 2 of a countertop is also conceivable. The shelf 2 enables here that domestic appliances in niches (for example, sloping roofs) such as coffee machine, toaster, or the like can only be moved forward if needed.

In general, embodiments as trays and as boxes are conceivable. A tray having organization elements for horizontal and/or vertical organization is also conceivable.

The guiding can take place vertically, hanging, or vertically and hanging.

The invention claimed is:

1. A household appliance or a furniture item having at least one storage space, in which at least one carrier plate having a bearing region and a shelf rotationally and translationally movable on the bearing region of the carrier plate are arranged, wherein the shelf has a planar bearing region, which is aligned plane-parallel to the bearing region of the carrier plate, wherein the shelf is rotatable in relation to the carrier plate in a first rotational direction and is displaceable in a predetermined direction, wherein bearing surfaces of the bearing regions facing toward one another each comprise at least one closed, peripheral running groove, in which roller bodies are guided, wherein the running grooves are formed in such a way that if a force acts on the shelf in a direction defined in the plane of the bearing region, the shelf is movable in an at least partially positively-guided, simultaneously rotational and translational movement from a base position into an intermediate position, during which the shelf is rotated in relation to the carrier plate in one of two possible opposing rotational directions and is displaced in a predetermined direction, wherein the shelf, after the movement into the intermediate position, is pivotable in relation to the carrier plate further in the one of two possible opposing rotational directions and is displaceable opposite to the predetermined direction and occupies the base position again upon a pivot by 180°.

2. The household appliance or furniture item according to claim 1, wherein two closed, peripheral running grooves are introduced into one of the bearing regions and precisely one closed, peripheral running groove is introduced into the other of the bearing regions.

3. The household appliance or furniture item according to claim 1, wherein the roller bodies are formed as balls.

4. The household appliance or furniture item according to claim 1, wherein four roller bodies positioned spaced apart from one another are guided in the running grooves.

5. The household appliance or furniture item according to claim 1, wherein the roller bodies are held in a roller body cage.

6. The household appliance or furniture item according to claim 1, wherein the bearing regions are formed in one piece with the carrier plate or the shelf, respectively.

7. The household appliance or furniture item according to claim 1, wherein at least one of the bearing regions is formed as a separate element, which is insertable into a correspondingly shaped receptacle in the carrier plate or the shelf or is attachable by connecting means to the carrier plate or the shelf, respectively.

8. The household appliance or furniture item according to claim 1, wherein a guide is arranged in one of the bearing regions and a guiding and holding element is arranged in or on the other bearing region.

9. The household appliance or furniture item according to claim 1, wherein the closed peripheral running grooves are each introduced around the center point of the bearing region of the shelf and the bearing region of the carrier plate up to a front edge of the carrier plate in the direction of the translational movement of the shelf.

10. The household appliance or furniture item according to claim 1, wherein the closed peripheral running grooves have multiple catch points for the roller bodies in the base position, which are reached after each rotation of the shelf by 180°.

11. The household appliance or furniture item according to claim 1, wherein the shelf does not protrude over a rear edge of the carrier plate opposite to the direction of the translational movement of the shelf during the entire movement.

12. The household appliance or furniture item according to claim 1, wherein the carrier plate is installable recumbent or hanging or standing vertically in the storage space.

13. The household appliance or furniture item according to claim 1, wherein the carrier plate is secured in the storage space or on a storage surface.

14. The household appliance or furniture item according to claim 1, wherein the shelf has more than one bearing region and interacts with more than one carrier plate.

15. The household appliance or furniture body of claim 5 wherein the roller bodies are held captively in the roller body cage.

16. The household appliance or furniture body of claim 1 wherein the running grooves are not parallel to each other.

* * * * *